US005516460A

United States Patent [19]

Au

[11] Patent Number: 5,516,460

[45] Date of Patent: May 14, 1996

[54] DETERGENT COMPOSITIONS COMPRISING ALDOBIONAMIDES

[75] Inventor: Van Au, New City, N.Y.

[73] Assignee: Lever Brothers Company, Division of Conopco, Inc., New York, N.Y.

[21] Appl. No.: 518,902

[22] Filed: Aug. 24, 1995

Related U.S. Application Data

[63] Continuation-in-part of Ser. No. 224,950, Apr. 8, 1994, abandoned.

[51] Int. Cl.[6] ..... C11D 1/831; C11D 3/32; C11D 3/382

[52] U.S. Cl. ..... 252/548; 252/174.17; 252/174.21; 252/553; 252/559

[58] Field of Search ..... 252/548, 174.17, 252/174.21, 553, 559

[56] References Cited

U.S. PATENT DOCUMENTS

| | | | |
|---|---|---|---|
| 2,752,334 | 6/1956 | Walton | 260/211 |
| 3,988,433 | 10/1976 | Benedict | 424/53 |
| 5,296,588 | 3/1994 | Au et al. | 536/1.11 |
| 5,310,542 | 5/1994 | Au et al. | 424/52 |
| 5,336,765 | 8/1994 | Au et al. | 536/18.5 |
| 5,389,279 | 2/1995 | Au et al. | 252/108 |
| 5,401,839 | 3/1995 | Au et al. | 536/18.7 |
| 5,416,075 | 5/1995 | Carson et al. | 514/23 |
| 5,433,883 | 7/1995 | Massaro et al. | 252/174.17 |

FOREIGN PATENT DOCUMENTS

| | | |
|---|---|---|
| 0550106 | 7/1993 | European Pat. Off. . |
| 0550278 | 7/1993 | European Pat. Off. . |
| 0550281 | 7/1993 | European Pat. Off. . |
| 9403468 | 2/1994 | WIPO . |
| 9412511 | 6/1994 | WIPO . |

OTHER PUBLICATIONS

Williams et al. "Synthesis of a New Class of Model Glycolipids" Chem. Abstract No. CA 90:87774k 1978 (no month available).

Williams et al. "A New Class of Model Glycolipids: Synthesis, Characterization and Interaction with Lectons", Archives of Biochem & Biophysics, 195(1):145–151; Jun. 1979.

*Primary Examiner*—Erin M. Harriman

*Attorney, Agent, or Firm*—Ronald A. Koatz

[57] ABSTRACT

The present invention relates to a detergent composition comprising:

(1) 5% to 95% by wt. anionic surfactant; and (2) 5% to 95% by wt. of a detergent surfactant mixture comprising:

(a) a nonionic surfactant having an average degree of alkoxylation of 6 to 10; and (b) an aldobionamide.

5 Claims, 7 Drawing Sheets

Detergency
LAS + (25% LBA + 75% Neodol 25-7)

- * Mixture of (a) linear alkylaryl sulfonate(LAS) (0-100% plotted on X-axis) and (b) 0-100% lactobionamide(LBA) plus nonionic Neodol25-7 in 1:3 ratio of LBA to nonionic
- ** here LBA was replaced with low EO nonionic

Detergency
LAS +(50% LBA + 50% Neodol-25-7)

- * Mixture of (a) linear alkylaryl sulfonate(LAS) (0-100% plotted on X-axis) and (b) 0-100% lactobionamide(LBA) plus nonionic Neodol25-7 in 1:1 ratio of LBA to nonionic
- ** here LBA was replaced with low EO nonionic

Detergency
LAS + (75% LBA + 25% Neodol25-7)

- * Mixture of (a) linear alkylaryl sulfonate(LAS) (0-100% plotted on X-axis) and (b) 0-100% lactobionamide(LBA) plus nonionic Neodol25-7 in 3:1 ratio of LBA to nonionic
- ** here LBA was replaced with low EO nonionic

Detergency
LAS +(25% MBA + 75% Neodol25-7)

- * Mixture of (a) linear alkylaryl sulfonate(LAS) (0-100% plotted on X-axis) and (b) 0-100% Maltobionamide(MBA) plus nonionic Neodol25-7 in 1:3 ratio of MBA to nonionic
- ** here MBA was replaced with low EO nonionic

Detergency LAS +(50% MBA + 50% Neodol25-7)

- * Mixture of (a) linear alkylaryl sulfonate(LAS) (0-100% plotted on X-axis) and (b) 0-100% Maltobionamide(MBA) plus nonionic Neodol25-7 in 1:1 ratio of MBA to nonionic
- ** here MBA was replaced with low EO nonionic

Detergency LAS +(75% MBA + 25% Neodol25-7)

- * Mixture of (a) linear alkylaryl sulfonate(LAS) (0-100% plotted on X-axis) and (b) 0-100% Maltobionamide(MBA) plus nonionic Neodol25-7 in 3:1 ratio of MBA to nonionic
- ** here MBA was replaced with low EO nonionic Detergency
LAS + (75% LBA + 25% C12EO3) on WFK30d cloth Delta R
13
12
11
10
9
8
7
6
0
20
40
60
80
100
LAS %
*75%CocoLBA
25%C12EO3
* Mixture of (a) linear alkylaryl sulfonate(LAS) (0-100% plotted on X-axis) and (b) 0-100% lactobionamide(LBA) plus C12EO3 (low EO ) in 3:1 ratio of LBA to nonionic

DETERGENT COMPOSITIONS COMPRISING ALDOBIONAMIDES

BACKGROUND

RELATED APPLICATIONS

The subject application is a continuation-in-part of U.S. Ser. No. 08/224,950 filed Apr. 8, 1994, now abandoned.

FIELD OF THE INVENTION

The present invention relates to detergent compositions comprising aldobionamides as nonionic surfactant.

BACKGROUND AND RELATED REFERENCES

Aldobionamides and compositions containing aldobionamides are known in the art, for example, from applicants' copending application, U.S. Ser. No. 07/981,737 now U.S. Pat. No. 5,389,279.

U.S. Pat. No. 5,389,279 to Au et al. describes binary active detergent active compositions in which nonionic aldobionamides are used in combination with anionic surfactants (e.g., linear alkybenzene sulfonates or LAS) instead of combinations of LAS and the high alkoxylated nonionic surfactants (e.g., Neodol 25-7, a nonionic surfactant from Shell having a $C_{12}$–$C_{15}$ alkyl group and alkoxylated with average seven alkylene oxide groups). That is, U.S. Pat. No. 5,389,279 compares LAS/Aldobionamide surfactant system relative to LAS/high EO nonionic systems.

The examples in Au et al. show that aldobionamides could perform at par or better than the highly alkoxylated nonionic surfactants one normally would use in a binary surfactant system and thus could be used as a replacement for such highly alkoxylated surfactants.

There is, however, no teaching or suggestion in Au et al. that the aldobionamides could be used as replacements for low alkoxylated nonionic surfactants (i.e., having average degree of alkoxylation from 1 to 5) in surfactant systems comprising such low EO nonionics; and, in fact, their successful use as replacement for high alkoxylated nonionic surfactants teaches away from the use as low alkoxylated nonionic replacer.

SUMMARY OF THE INVENTION

Unexpectedly, applicants have now discovered that if the aldobionamides are used in a tertiary surfactant system as a replacement for low alkoxylated nonionic surfactants, they function in a far superior manner to the low alkoxylated nonionics normally used (i.e., those nonionic surfactants having an average degree of alkoxylation of from about 1 to 5). That is, there is a synergy between a system comprising (1) anionic plus (2) a mixture of (a) high EO nonionic and (b) lactobionamide while there is no such detergent synergy for a system comprising anionic and a mixture of (a) high EO nonionic and (b) low EO nonionic.

More specifically, applicants have discovered that the lactobionamides can be used to replace "low" alkoxylated nonionics in tertiary systems additionally comprising (1) an anionic surfactant and (2) a high alkoxylated nonionic surfactant (i.e., having average degrees of alkoxylation of 6 and up) to provide a detergency synergy not observed when known low alkoxylated nonionic surfactants were used in the same system. In short anionic/high EO/lactobionamide systems provide synergy not seen in anionic/high EO/low EO systems.

DETAILED DESCRIPTION OF THE INVENTION

Figure 1:
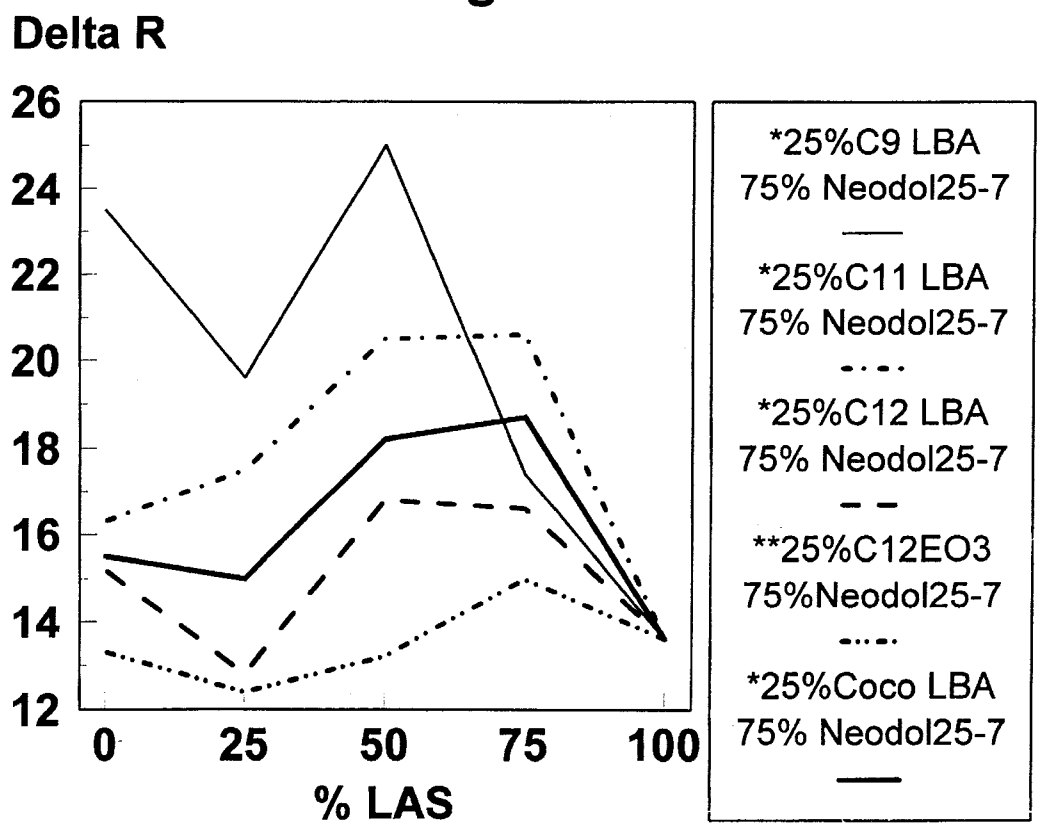
FIG. 1 shows detergency results for various chain length lactobionamides when anionic LAS (linear alkyl aryl sulfonate, e.g., linear alkylbenzene sulfonate) is combined with a mixture of the various chain lengths lactobionamides (LBA) and Neodol 25-7 (Neodol) at ratio of LBA to Neodol of 25:75. Comparative with 25% $C_{12}EO_3$ is also shown. A can be seen, when different chain length LBA is used, there is always detergent synergy. When 25% $C_{12}EO_3$ is used to replace 25% LBA, there is little or no synergy.

The present invention relates to detergent compositions comprising at least the following three required components: (1) an anionic surfactant; (2) a nonionic surfactant having an average degree of alkoxylation of 6 and higher, preferably 6 to 10; and (3) an aldobionamide as described in greater detail herein.

Preferably, the amount of aldobionamide used should be equal to or lower than the amount of high alkoxylated nonionic, i.e., preferably from 50% by wt. aldobionamide: 50% by wt. other nonionic to 1% aldobionamide: 99% other nonionic. This is not, however, a requirement of the invention and the invention will work even if the amount of aldobionamide exceeds the amount of other nonionic.

Suitable anionic surfactants are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced, for example, from tallow or a coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glycerol ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulfuric acid esters of higher ($C_8$–$C_{18}$) fatty alcohol-alkylene oxide, particularly ethylene oxide, reaction products: the reaction products of fatty acids such as coconut fatty acids esterified with isethionic acid and neutralized with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolyzing with a base to produce a random sulphonate; and olefin sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkyl benzene sulphonates and sodium ($C_{16}$–$C_{18}$) alkylsulphates.

Other examples of anionic surfactants are described in "Surface Active Agents and Detergents" (Vol. I & II) by Schwartz, Ferry and Bergh, hereby incorporated by reference into the subject application. Any suitable anionic may be used and the examples are not intended to be limiting in any way.

The anionic surfactant will comprise 5% to 95% by wt. of the tertiary surfactant system, preferably 25% to 80% by wt.

Suitable nonionic surfactants include, ion particular, the reaction products of compounds having a hydrophobic group and a reactive hydrogen atom, for example aliphatic alcohols, acids, amides or alkyl phenols with alkylene oxides, especially ethylene oxide, either alone or with propylene oxide. Specific nonionic detergent compounds are alkyl ($C_6$–$C_{18}$) primary or secondary linear or branched alcohols with ethylene oxide, and products made by condensation of ethylene oxide with the reaction products of propylene oxide and ethylenediamine.

In addition the average degree of alkoxylation with the alkylene oxide should be 6 to 10. The degree of alkoxylation is of course the number of alkylene oxide groups on the molecule.

The nonionic surfactant will comprise 5% to 95% by wt. of the tertiary active system, preferably 20% to 75% by wt.

In a preferred embodiment of the invention, the nonionic surfactant should comprise 50% or less of the total of nonionic and lactobionamide used together. This is not a requirement, however, and the compositions may still comprise aldobionamide and nonionic wherein there is more nonionic relative to aldobionamides.

The final component of the tertiary surfactant system is the aldobionamide. This is itself a nonionic although different than the nonionic described above.

Aldobionamides are defined as the amide of an aldobionic acid (or aldobionolactone) and an aldobionic acid is a sugar substance (e.g., any cyclic sugar comprising at least two saccharide units) wherein the aldehyde group (generally found at the $C_1$ position of the sugar) has been replaced by a carboxylic acid, which upon drying cyclizes do an aldonolactone.

An aldobionamide may be based on compounds comprising two saccharide units (e.g., lactobionamides or maltobionamides from the aldobionamide bonds), or they may be based on compounds comprising more than two saccharide units, as long as the terminal sugar in the polysaccharide has an aldehyde group. By definition an aldobionamide must have at least two saccharide units and cannot be linear. Disaccharide compounds such as lactobionamides or maltobionamides are preferred compounds. Other examples of aldobionamides (disaccharides) which may be used include cellobionamides, melibionamides and gentiobionamides.

A specific example of an aldobionamide which may be used for purposes of the invention is the disaccharide lactobionamide set forth below:

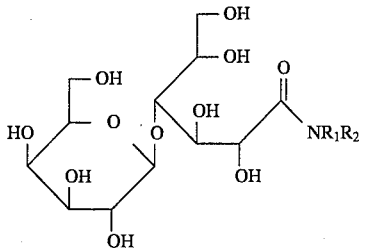

wherein $R_1$ and $R_2$ are the same or different and are selected from the group consisting of hydrogen; an aliphatic hydrocarbon radical (e.g., alkyl groups and alkene groups which groups may contain heteroatoms such as N, O or S or alkoxylated alkyl chains such as ethoxylated or propoxylated alkyl groups), preferably an alkyl group having 8 to 24, preferably 10 to 18 carbons; an aromatic radical (including substituted or unsubstituted aryl groups and arenes); a cycloaliphatic radical; an amino acid ester, ether amines and mixtures thereof, except that $R_1$ and $R_2$ cannot be hydrogen at the same time.

Suitable aliphatic hydrocarbon radicals include saturated and unsaturated radicals including but not limited to methyl, ethyl, amyl, hexyl, heptyl, nonyl, decyl, undecyl, dodecyl, tridecyl, tetradecyl, pentadecyl, hexadecyl, heptadecyl, octadecyl, allyl, undecenyl, olelyl, linoleyl, linolenyl, propenyl, and heptenyl.

Aromatic radicals are exemplified, for example, by benzyl.

Suitable mixed aliphatic aromatic radicals are exemplified by benzyl, phenyl ethyl, and vinyl benzyl.

Cycloaliphatic radicals are exemplified by cyclopentyl and cyclohexyl.

The aldobionamides used in the composition of the invention have surprisingly been found to be useful as a replacement for alkoxylated nonionic surfactants having low average degree of alkoxylation (i.e., 1–5); and have further been found to provide detergent synergy when used in the tertiary active systems of the invention relative to the use of the same systems where low alkoxylated nonionic surfactants are used instead of aldobionamides.

Unless stated otherwise, all percentages in the specification and examples are percentages by weight.

The following examples are intended to be illustrative of the invention only and are not intended to limit the claims in any way.

EXAMPLES

A lactobionamide of the invention was made as follows:

15 g of lactone were charged into 150 ml flask. 100 ml of methanol were added at 25° C. The batch was heated up to 50° C. 0.15 of alkyl benzene sulfonic acid were charged into the reaction vessel. After this addition the mixture was held at 50° C. for 1 hour. 8.2 g of cocoamine were added at 50° C. in 30 minutes. The batch was then cooled down to 25° C. in 30 minutes and left overnight for crystallization. 19 g of white crystalline product were recovered after filtration.

DETERGENCY

Protocol

Detergency of the aldobionamides of the invention (e.g., lactobionamides) as a mixture with anionic and the other nonionic (i.e., high alkoxylated nonionic) was evaluated on a WFK 30D polyester cloth (polyester cloth coated with pigment/sebum) using a tergotometer. The performance of the aldobionamide was evaluated as a mixed system (ratio of LBA to Neodol was 25% to 75%; 50% to 50% or 75% to 25% and percentages of LAS:Nonionic combined was also 25% to 75%; 50% to 50% and 75% to 25%) at about 0.22 g/L total surfactant. A non-phosphate, zeolite built burkite (sodium carbonate) base powder comprising about 0.45 g/L of commercially available zeolite powder (Zeolite 4A) and 0.30 g/L sodium carbonate was dosed over the side at about 1.0 g/L.

The ratio of total surfactant to zeolite base powder was about 22%. The system was kept at 37° C., pH 10, 120 ppm hardness (added as 2:1 ratio of Ca:Mg) for 15 minutes.

Detergency improvement was measured as a change in reflectance (ΔR) of the stained cloth before and after washing with the detergent prototype as measured in a standard reflectometer. In general, larger reflectance values suggest better detergency and oily soil removal.

EXAMPLE 1

In this first example, linear alkylbenzene sulphonate (LAS) (anionic) was mixed with 1 to 100% by wt. of a mixture of lactobionamide (LBA) and Neodol 25-7 (a nonionic having average degree of ethoxylation of 7 and $C_{12}$–$C_{15}$ average claim length) such that ratio of LAS to Neodol was 25% to 75%. Various chain length lactobionamides were tested as well as one example of LAS, Neodol 25-7 and $C_{12}$–$EO_3$ (low alkoxylated nonionic) instead of aldobionamide. The results are set forth in FIG. 1.

As seen in FIG. 1, when aldobionamide (LBA) instead of low ethoxylated nonionic ($C_{12}EO_3$) is combined with high alkoxylated nonionic and used in tertiary surfactant system with an anionic surfactant, there is always a detergent synergy. The $C_{12}EO_3$ provides little or no synergy. This is unexpected in that there is nothing in the art to suggest that a lactobionamide could replace a low alkoxylated nonionic, let alone that it could provide such detergent synergies.

EXAMPLE 2

Figure 2:
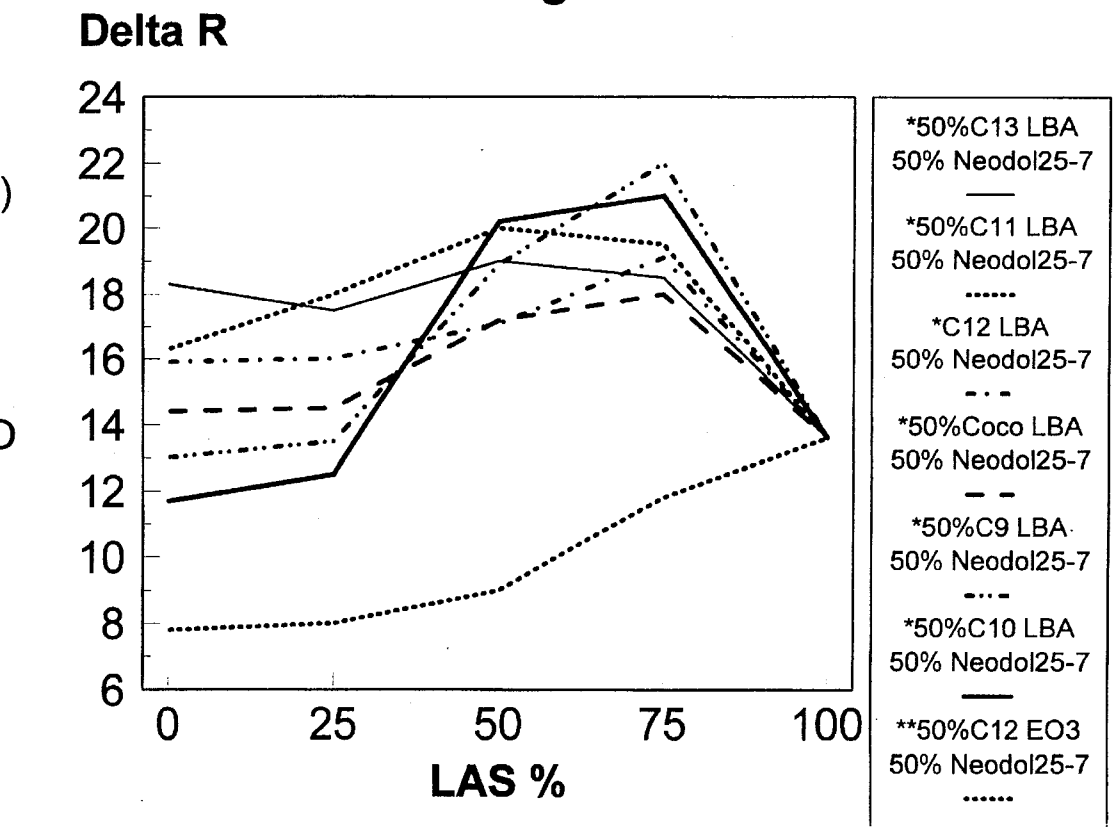
FIG. 2 is same as FIG. 1, but ratio of LBA to Neodol is 50:50. Again, when $C_{12}EO_3$, is used in place of LBA, there is little or no synergy.

Example 2 is similar to Example 1, but wherein ratio of aldobionamide to high alkoxylated nonionic is 50:50. There the superiority of aldobionamides over low alkoxylated nonionic (when used to replace) is shown in every case. This is seen from FIG. 2.

EXAMPLE 3

Figure 3:
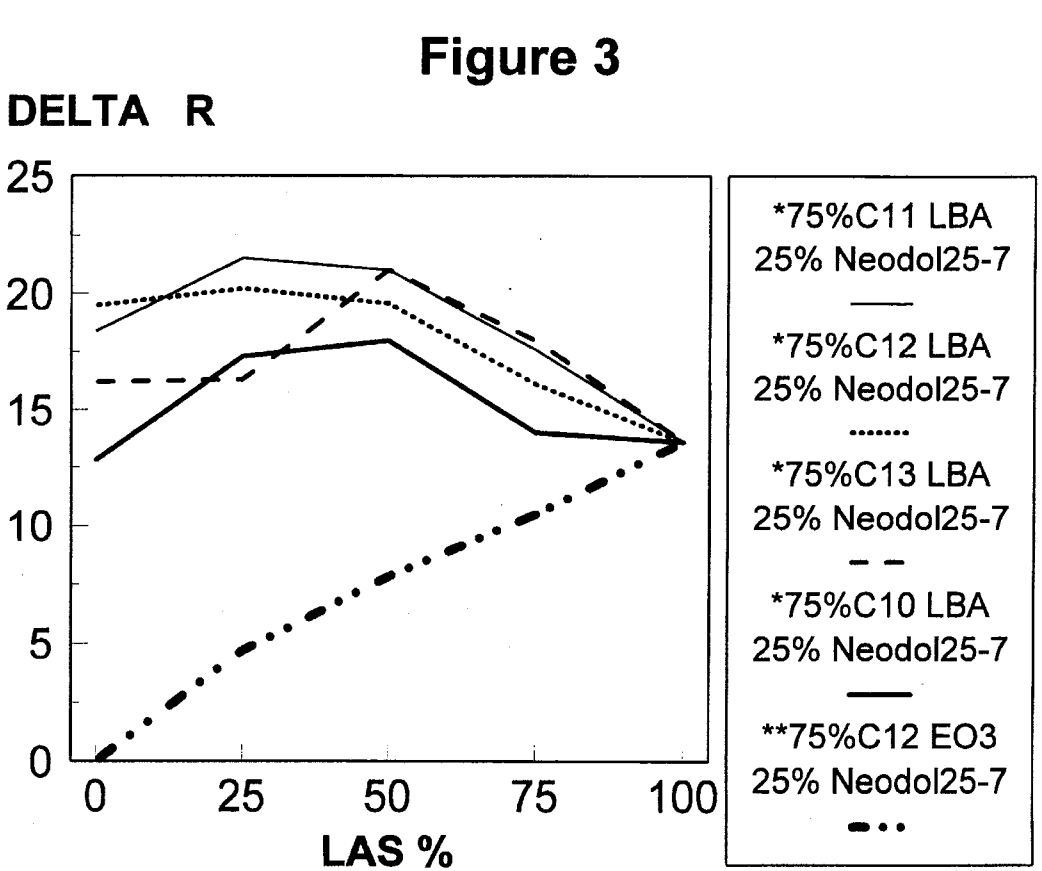
FIG. 3 is same as FIG. 1, but ratio of LBA to Neodol is 75:25. The same lack of synergy is observed using $C_{12}EO_3$.
Figure 4:
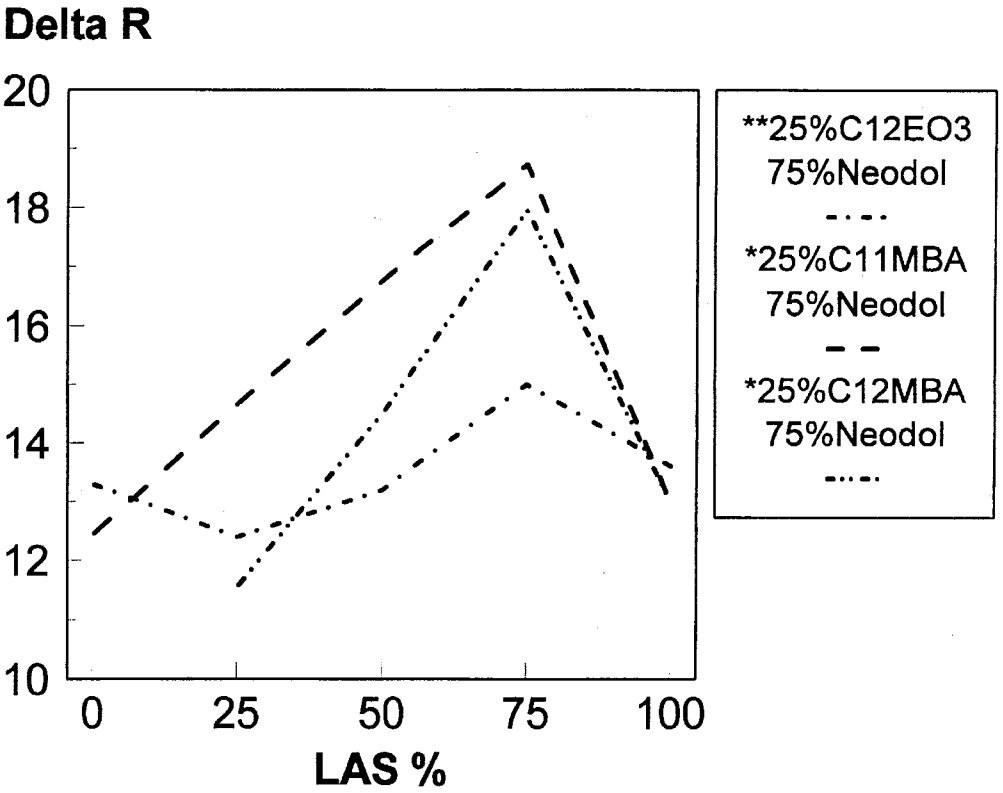
FIG. 4 is same as FIG. 1, but using maltobionamide (MBA) wherein ratio of MBA to Neodol is 25:75. Here, while synergy is not absent, it is still much greater for mixture when maltobionamide is used with Neodol rather than $C_{12}EO_3$.
Figure 5:
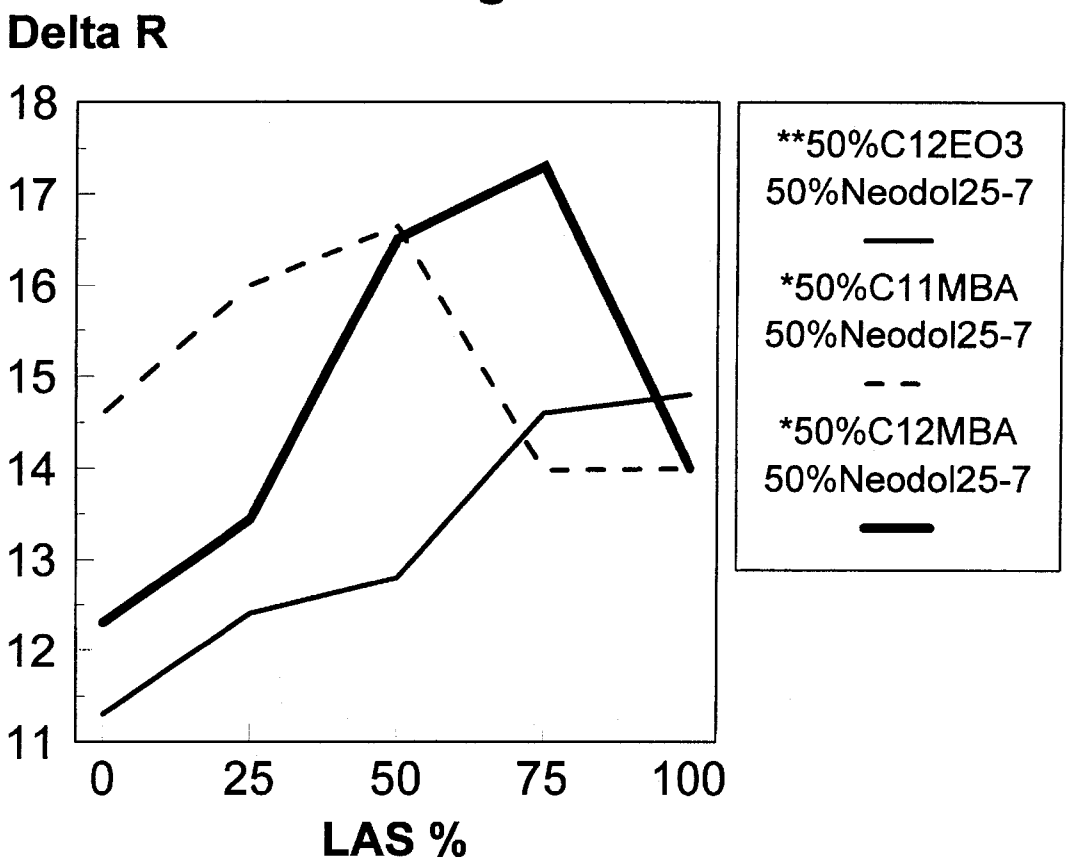
FIG. 5 is same as FIG. 4, but ratio of MBA to Neodol is 50:50.
Figure 6:
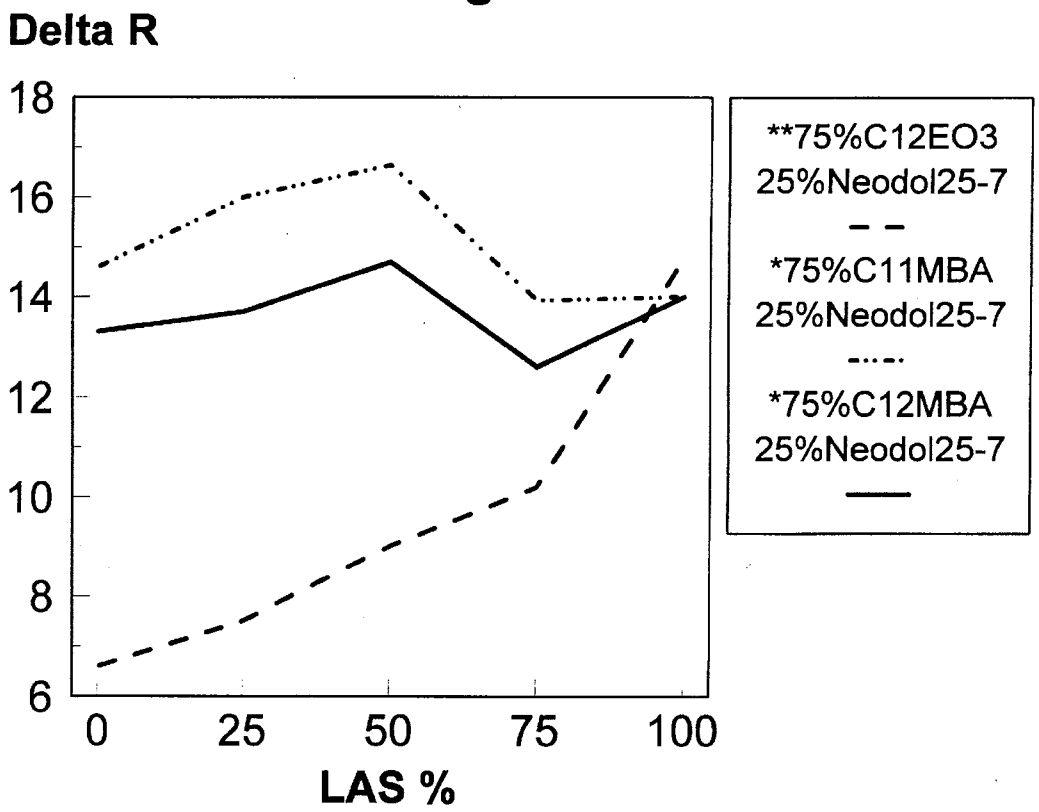
FIG. 6 is same as FIG. 4, but ratio of MBA to Neodol is 75:25.
Figure 7:
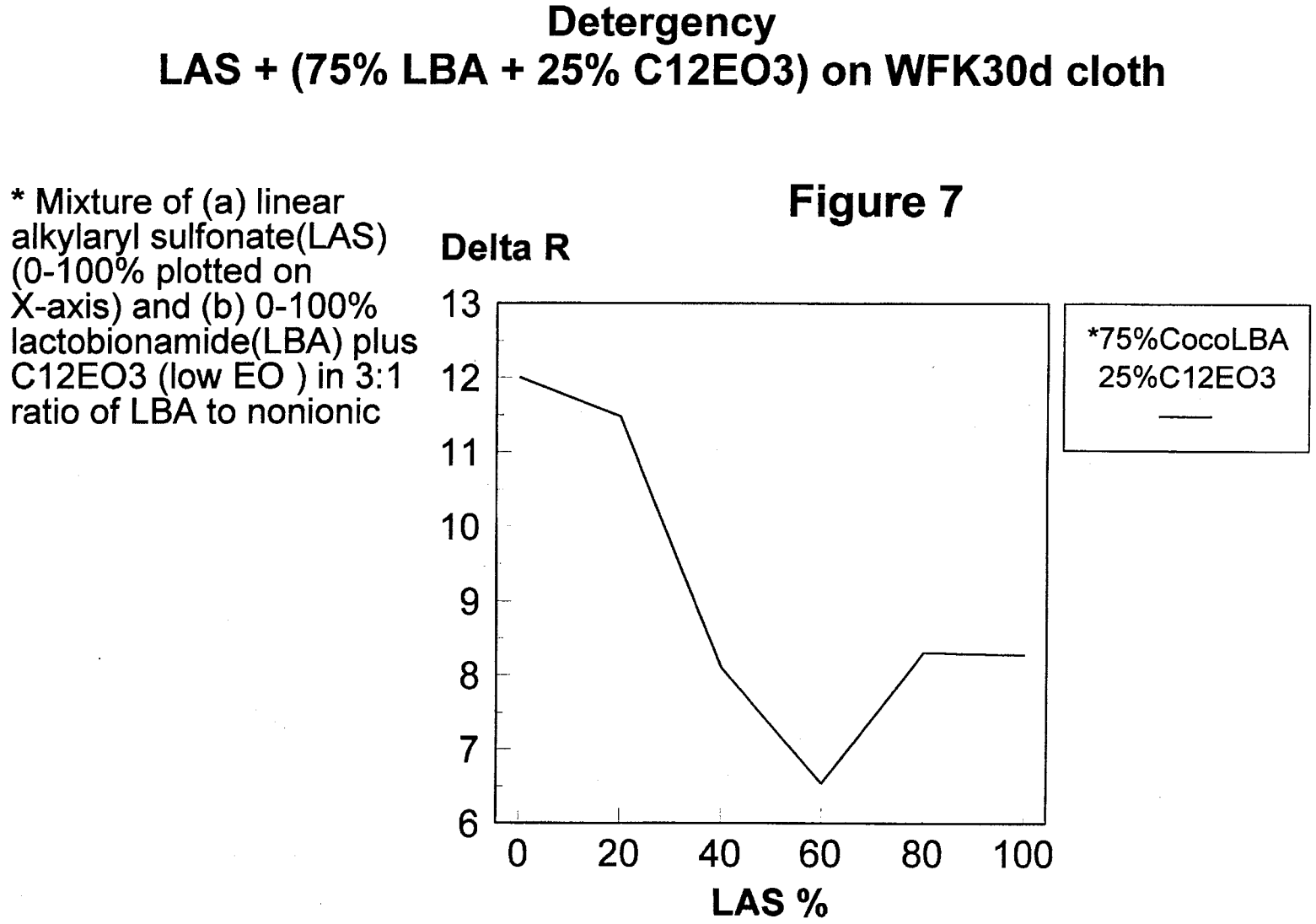
FIG. 7 is a more directed comparative intended to show that LAS/aldonamide/high EO yields synergies not seen with LAS/aldonamide/Low EO. When aldonamide is with high EO nonionic, there is a synergy (see FIG. 3), but when aldonamide is with low EO nonionic (FIG. 7), there is no synergy whatsoever.

Example 3 is like Example 1 and 2 except ratio of aldobionamide to high alkoxylated nonionic is 75:25. This is seen in FIG. 3. As in FIG. 2, the superiority of aldobionamide as a replacement for a low alkoxylated nonionic is seen in every case.

EXAMPLE 4

Example 4 is like Example 1 except it teaches a ratio of maltobionamide rather than lactobionamide to high alkoxylated nonionic of 25:75. The superiority of aldobionamides over low alkoxylated nonionic is shown in every case.

EXAMPLE 5

Example 5 is like Example 4 except the ratio of maltobionamide to high alkoxylated nonionic is 50:50.

EXAMPLE 6

Example 6 is like Example 4 except the ratio of maltobionamide to high alkoxylated nonionic is 75:25.

EXAMPLE 7

Example 7 shows that when aldobionamide is used to replace the high EO nonionic surfactant to form an anionic/aldobionamide/Low EO nonionic surfactant system, there is no synergy whatsoever.

By contrast, an anionic/aldobionamide/high EO surfactant system at same ratios of aldobionamide to nonionic does show synergy.

I claim:

1. A detergent composition comprising:

(1) 5% to 95% by wt. linear alkylaryl sulfonate; and (2) 5% to 95% by wt. of a detergent surfactant mixture comprising (a) a nonionic surfactant wherein said nonionic surfactant is the reaction product of an aliphatic alcohol, acid, amide or alkyl phenol with alkylene oxide and has an average degree of alkoxylation of 6 to 10; and (b) an aldobionamide selected from the group consisting of lactobionamide, maltobionamide and mixtures thereof wherein the ratio of aldobionamide to nonionic surfactant varies from 25:75 to 75:25.

2. A composition according to claim 1, wherein the lactobionamide has the structure

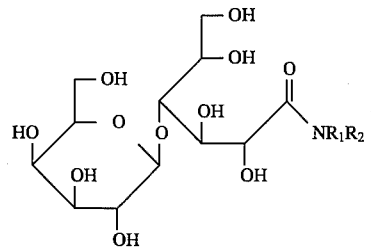

wherein $R_1$ and $R_2$ are the same or different and are selected from the group consisting of hydrogen, aliphatic hydrocarbons, aromatic radicals, cycloaliphatic radicals, amino acid esters, ether amines and mixtures thereof, except that $R_1$ and $R_2$ cannot be hydrogen at the same time.

3. A composition according to claim 2, wherein on the lactobionamide, $R_1$ is hydrogen and $R_2$ is an alkyl group having 8 to 24 carbons.

4. A composition according to claim 1, wherein the aldobionamide is maltobionamide having the structure:

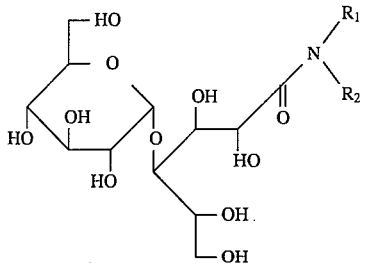

wherein R and $R_1$ are the same or different and are selected from the group consisting of hydrogen, aliphatic hydrocarbons, aromatic radicals, cycloaliphatic radicals, amino acid esters, ether amines, and mixtures thereof, except that $R_1$ and $R_2$ cannot by hydrogen at the same time.

5. A composition according to claim 4, wherein on the maltobionamide, $R_1$ is hydrogen and $R_2$ is an alkyl group having 8 to 24 carbons.

* * * * *